United States Patent [19]

Suhh

[11] Patent Number: 4,493,576

[45] Date of Patent: Jan. 15, 1985

[54] OIL MOP

[76] Inventor: Jay Y. Suhh, 20125 Labrador, Chatsworth, Calif. 91311

[21] Appl. No.: 458,656

[22] Filed: Mar. 10, 1983

[51] Int. Cl.[3] ..... A46B 11/04

[52] U.S. Cl. ..... 401/283; 401/22; 401/24; 401/140; 401/270

[58] Field of Search ..... 401/283, 288, 24, 22, 401/140, 270, 289, 290, 183

[56] References Cited

U.S. PATENT DOCUMENTS

| | | | |
|---|---|---|---|
| 1,059,528 | 4/1913 | Davis | 401/288 |
| 1,087,793 | 2/1914 | Lemieux | 401/283 |
| 1,623,004 | 3/1927 | Greenberg | 401/183 |
| 1,628,789 | 5/1927 | Kootz | 401/283 |
| 2,567,764 | 9/1951 | Davies | 401/22 |
| 3,056,997 | 10/1962 | Cummings | 401/22 |

FOREIGN PATENT DOCUMENTS

| | | | |
|---|---|---|---|
| 231850 | 7/1925 | United Kingdom | 401/290 |

*Primary Examiner*—Steven A. Bratlie
*Attorney, Agent, or Firm*—Gilbert Kivenson

[57] ABSTRACT

An oil mop employing oil-saturable wiping assemblies is described. The assemblies are fed from a reservoir made up of non-saturable cords and batting. This reservoir is supplied from a primary storage volume contained in a hollow mop handle through a non-saturable wick connecting the handle with the reservoir.

3 Claims, 7 Drawing Figures

OIL MOP

This invention relates to an improved oil mop construction for use in cleaning vehicles, furniture, wall surfaces and the like. Although the use of oiled mop heads is not a new practice, it is very inconvenient with ordinary mops to maintain an oil content suitable for efficient cleaning. There is consequently a tendency for the user to neglect adding oil. This results in a fall off in both mop effectiveness and mop head life.

Mops with short side handles are generally used by holding them in one hand. On occasion however the second hand is needed to apply additional pressure. Present mop construction does not permit this without soiling of the second hand or the latter coming in contact with the surface being cleaned.

It is an objective of the present invention to provide continuous means for maintaining a desired degree of oil impregnation in the elements of the mop during use.

It is a further objective of the present invention to provide a sealed upper mop surface which will prevent oil contact with surfaces not being cleaned.

It is a third objective of the invention to provide considerable internal oil storage so that the mop may be used for extended periods without being re-oiled.

It is a fourth objective of this invention to incorporate a design which permits convenient manufacturing of the mop in different head heights to accommodate various applications.

In accordance with this invention these objectives may be attained by a mop construction comprising in combination a frame, a number of single pouch wiping assemblies, a number of double pouch wiping assemblies, a combining ferrule, a hollow handle serving for oil storage and a cover for the wiping assemblies. The frame contains one or more rods on which are mounted the wiping assemblies. Upper pouches, which are sewed into all the wiping assemblies, hold the frame rods. Lower pouches, which are sewed into some of the assemblies, contain non-saturating, oil transmitting cords which extend into the space between the assemblies. The spaces are, in addition, filled with batts of non-saturating material.

The oil mop construction will now be described in greater detail with reference to the accompanying figrues in which.

Figure 6:
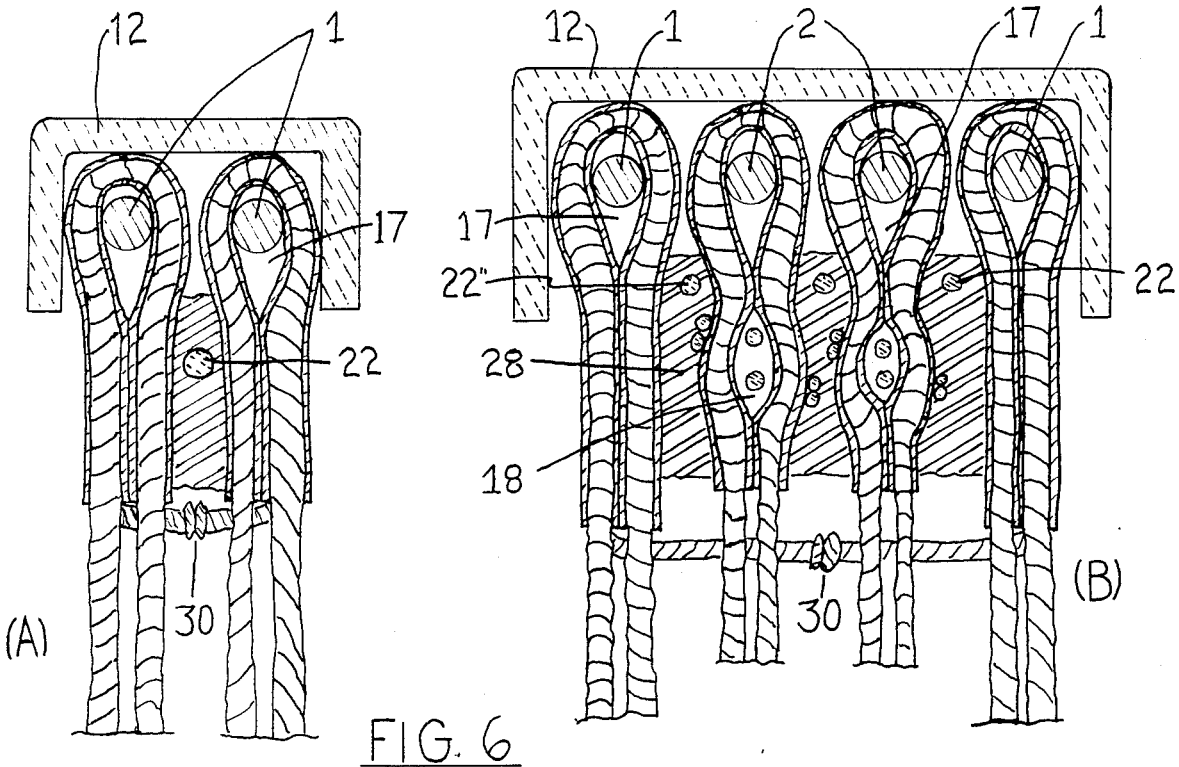

FIGS. 6(A) and 6(B) are cross sections of two element and four element mops.

Figure 1:
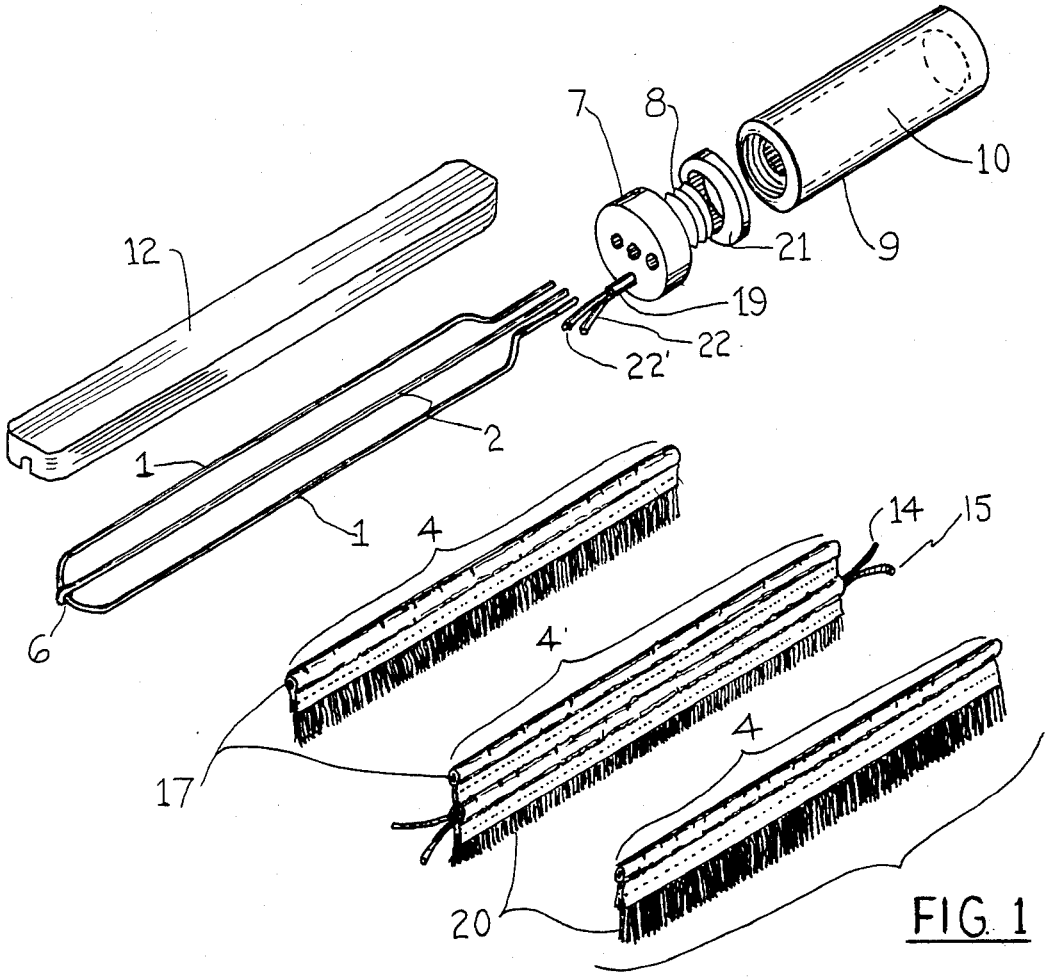
Fig. 1 is an exploded view of the various elements of a three element mop.
Figure 5:
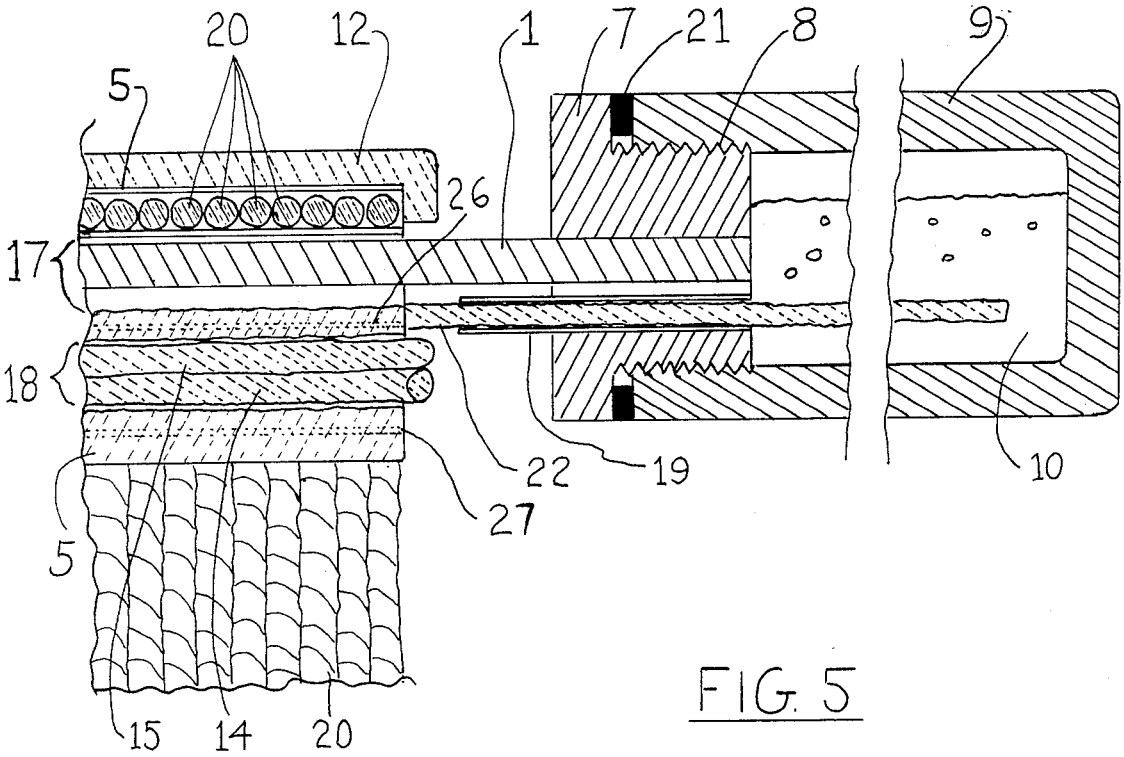
FIG. 5 is a partial cross section of the mop taken along B—B' of FIG. 3.

In FIG. 1 the rod 1 is bent in a U shape with its ends bent in to be separated by approximately three rod diameters as shown. A second, shorter rod 2, is welded to rod 1 at point 6 and terminates at its other end nearly in contact with the ends of rod 1. A joining ferrule 7, shown in FIG. 1 and in detail in FIG. 5, is provided with four holes to receive the ends of rod 1, the end of rod 2 and an oil transfer tube 19. The ferrule is threaded at 8. A handle 9 containing an oil storage volume 10 is threaded along part of its interior to permit engagement through the washer 21 with thread 8 in the joining ferrule.

Figure 2:
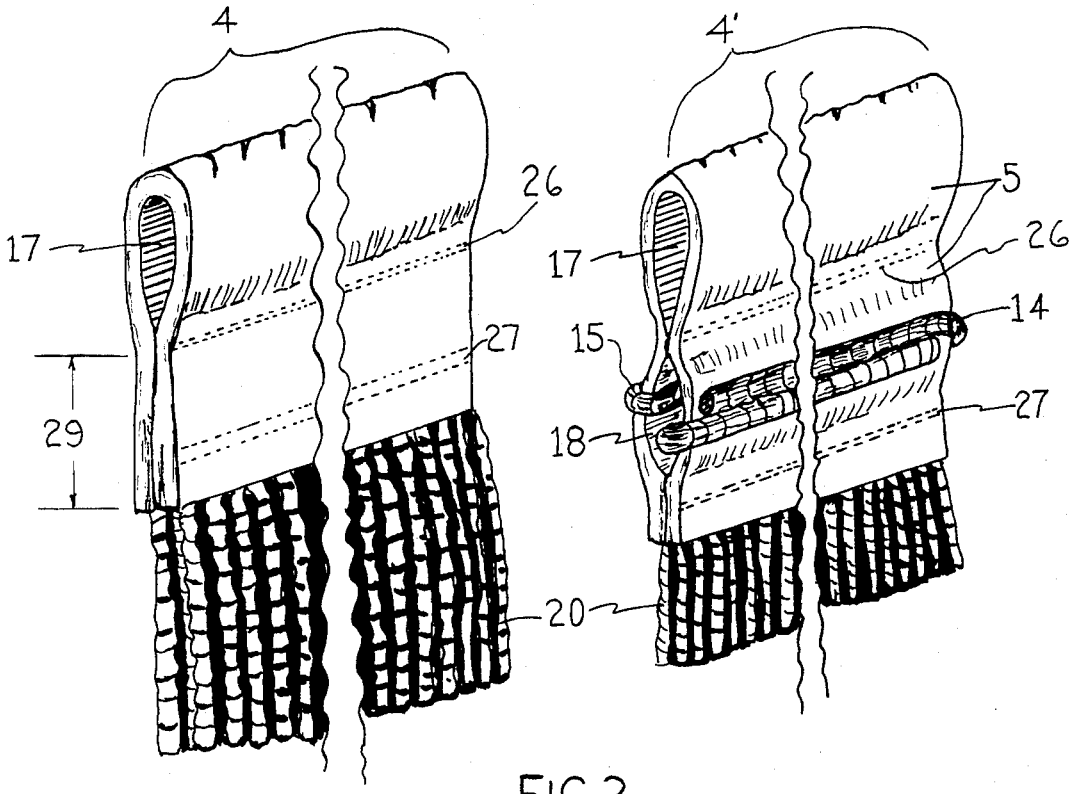
FIG. 2 shows details of the single pouch and double pouch wiping assemblies.
Figure 3:
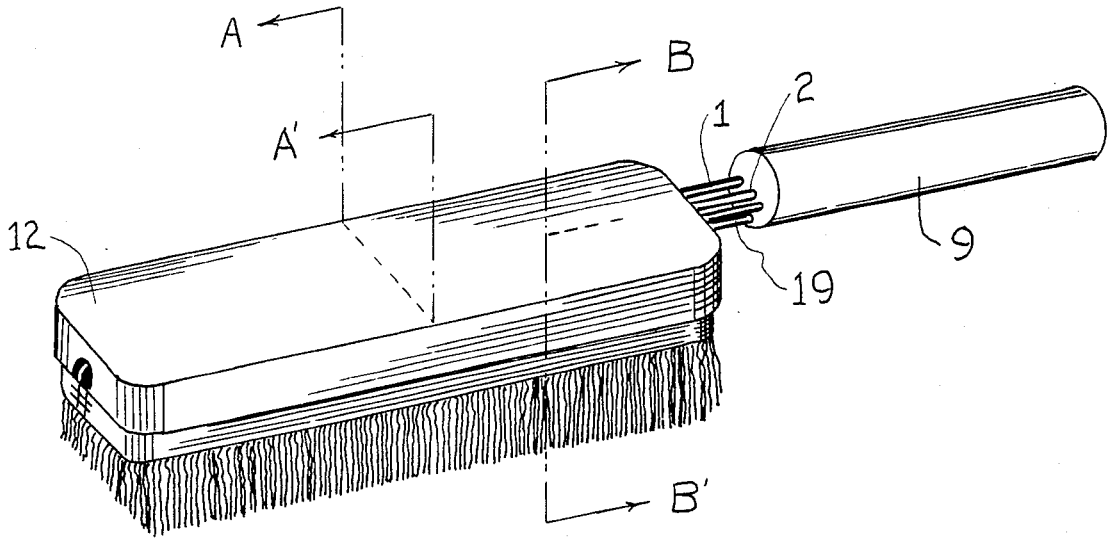
FIG. 3 is a perspective view of the assembled mop.

A single pouch wiping assembly 4 is made up of the cotton rope segments 20 sewn into the polyester panel 5 with stitching at 27, FIG. 2. A pouch 17 is formed by the stitching at 26. The height of the mop is controlled by varying the width of the polyester panel 5 so as to increase or decrease the dimension 29.

A double pouch assembly is similarly made except that two pouches 17 and 18 are formed by the stitching at 26 and 27. The two oil transport cords 14 and 15 are made up of polymeric fibers which are themselves impermeable to oil but can act as wicks to carry oil by capillary action. Suitable polymeric materials would include polyesters, nylon and dacron. Cords 14 and 15 are approximately three times as long as the pouch in which they are contained. This permits them to be wrapped around the outside of the polyester panels as is shown in FIG. 2.

Figure 4:
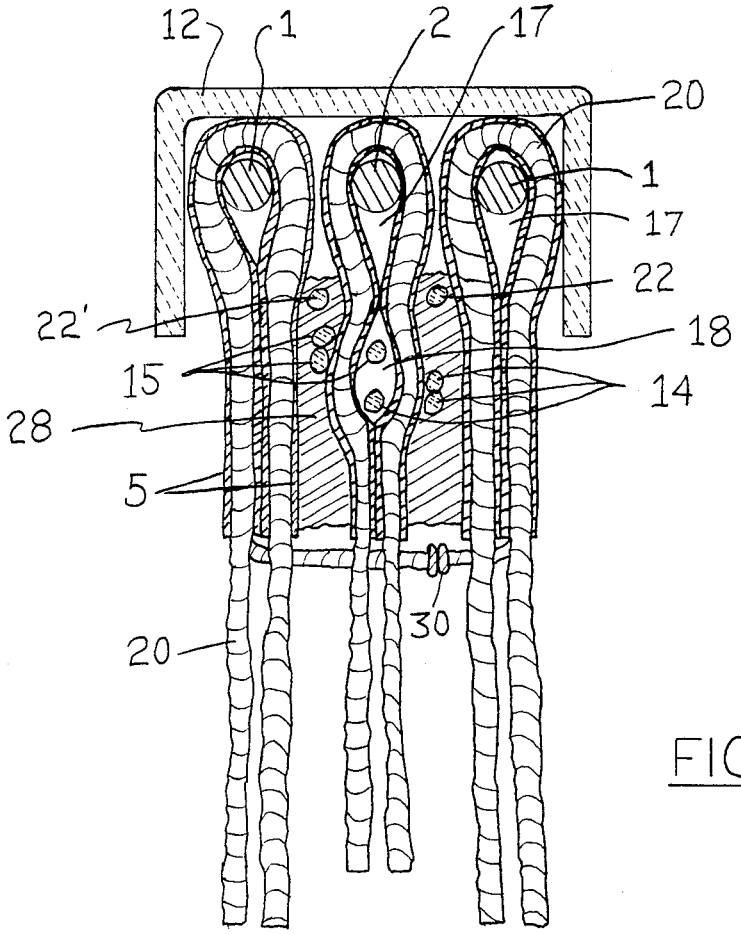
FIG. 4 is a cross sectional view taken along A—A' of FIG. 3.

The spaces between the outer single pouch assemblies and the inner double pouch assembly are filled with polyester batting which will act as a non-saturating, oil storage volume, 28 in FIG. 4. This oil will be transferred to the outer surfaces of the panels and to the insides of the lower pouch by means of the wicks 14 and 15. the panels of the double pouch assembly will thus receive oil from both the batting and from the wicks. The cotton cords of the double pouch assembly will therefore be fed more oil than those in the outside assemblies. During use, the center assembly acts as a primary oil source while the outside assemblies serve to distribute it uniformly and to function as cleaning elements.

The oil storage reservoir formed by the batting is fed from the wicks 22 and 22' shown in FIGS. 4 and 5. These wicks pass through the oil transport tube 19 and are immersed in the oil reservoir 10 in the handle 9.

The cover 12 is drawn over the upper portion of the wiping assemblies and prevents oil from contacting surfaces not being cleaned. This cover will also serve as an auxilliary handle when additional pressure must be exerted on the wiping assemblies.

To provide a firm storage volume several of the cotton cords of the outer wiping assemblies are tied together at 30 as is shown in FIG. 4.

Prior to initial use the mop is primed by pouring oil directly into the spaces between the wiping assemblies from the top with the cover removed. When the liquid has permeated through the wiping assemblies and the polyester batts, the cover is replaced. As a final step prior to use, the reservoir in the handle is filled.

When the mop is rubbed over a dusty surface, particulates will adhere to the cotton rope segments because of oil adhesiveness and electrostatic attraction. As the number of particles retained by the mop increases, there will be agglomeration of the fine material into larger particles. The latter can now be removed in the conventional manner by shaking. A fine, oily layer will be spread over and retained by the surface. This layer serves both as a polish and as a trap for subsequent deposits, preventing the latter from adhering directly to the surface and facilitating subsequent removal by further use of the invention. The oily layer also serves to inhibit surface oxidation.

As the mop is being used, the oil content of the cotton rope segments is depleted and a concentration gradient is formed between the segments and the oil supply carried by the polymeric batting. Capillary flow will be induced and will result in re-saturation of the cotton segments. The polymeric materials, being non-wetted by the oil, serve as poly-directional capillary conductors. The polymeric wicks 22 and 22' are also capillary conductors, carrying oil from the primary reservoir in the handle to the batting 28 from where some of it is taken up by the wicks 14 and 15 and transported into the lower pouch of the central wiping assembly. The oil next passes through the side panels of the central assembly and finally saturates the cotton rope segments. Oil deposited by the central segments on the surface being cleaned is partially absorbed by the outer rope segments.

The oil used may be of mineral, organic or synthetic base and may contain various additives. For example, paraffin base, glycerine or silicone materials may be used with the mop. To the oil may be added small amounts of surface activating agent, detergent or flow modifying substance. Viscosity may vary from one to 300 centipoise, the choice depending on the nature of the dust and the ambient temperature at which the mop is to be used.

The invention described has been based on a three wiping-assembly-construction. The invention can also be constructed with any number of assemblies to accommodate a wide range of applications. In the two element mop of FIG. 6(A) only single pouch wiping assemblies would be used. The oil conducting wick would be imbedded in the batting. In the four element mop of FIG. 6(B) the center elements would be of the two pouch type while the outer two assemblies would each contain a single pouch.

I claim:

1. An oil mop comprising in combination:

a. a rod frame formed of individual rods;

b. a hollow handle and ferrule assembly accommmodating one end of the rods of said rod frame and containing a wick filled tube;

c. single pouch wiping assemblies made up of oil insaturable, polymeric cloth panels with sewed-in saturable cord segments and incorporating one pouch for mounting on said rod frame;

d. double pouch wiping assemblies made up of oil insaturable polymeric cloth panels with sewed-in saturable cord segments and containing two pouches permitting the mounting on said rod frame and the containment of nonsaturable oil transmitting cords in and around the second pouch;

e. oil insaturable polymeric batting packed within the spaces between the mounted wiping assemblies to form an oil storing volume fed by a wick connecting a primary oil supply in the said hollow handle to the oil storing volume through said wick filled tube;

f. an oil resistant flexible cover drawn over the mounted single and double pouch wiping assemblies to prevent oil seepage from the top of the assembled mop and to serve as an auxiliary mop handle;

whereby oil from the primary oil supply in the hollow handle is drawn to the said oil storing volume by capillary action of said wick and hence to the second pouches of the two pouch wiping assemblies through said oil transmitting cords and finally to the saturable cord segments from where it can be brushed onto a surface being cleaned and produce, as it leaves the saturable cord segments, a concentration gradient which draws replacement oil from said oil storing volume, wicks and primary oil supply.

2. An oil mop as described in claim 1 which can be made up of any number of single and double wiping assemblies with the said double pouch wiping assemblies being contained in the central portion of the mop.

3. An oil mop as described in claim 1 in which mop height can be varied for various purposes during manufacture by adjustment of the widths of said oil insaturable polymeric cloth panels.

* * * * *